US007136026B2

(12) United States Patent
Lee

(10) Patent No.: US 7,136,026 B2
(45) Date of Patent: Nov. 14, 2006

(54) CABLE ANTENNA STRUCTURE

(75) Inventor: Chang-Jung Lee, Taoyuan (TW)

(73) Assignee: Accton Technology Corporation, Hsinchu (TW)

( * ) Notice: Subject to any disclaimer, the term of this patent is extended or adjusted under 35 U.S.C. 154(b) by 57 days.

(21) Appl. No.: 11/051,450

(22) Filed: Feb. 4, 2005

(65) Prior Publication Data

US 2006/0176238 A1 Aug. 10, 2006

(30) Foreign Application Priority Data

Mar. 16, 2004 (TW) ..... 93107031 A

(51) Int. Cl.
*H01Q 9/04* (2006.01)

(52) U.S. Cl. ..... 343/791; 343/790

(58) Field of Classification Search ..... 343/790, 343/791, 792, 702
See application file for complete search history.

(56) References Cited

U.S. PATENT DOCUMENTS

| | | | | |
|---|---|---|---|---|
| 6,081,236 | A * | 6/2000 | Aoki | 343/702 |
| 6,552,692 | B1 * | 4/2003 | Zeilinger et al. | 343/792 |
| 6,842,155 | B1 * | 1/2005 | Yeh | 343/790 |
| 2005/0212713 | A1 * | 9/2005 | Dai et al. | 343/792 |

* cited by examiner

*Primary Examiner*—Hoanganh Le
(74) *Attorney, Agent, or Firm*—Thomas, Kayden, Horstemeyer & Risley

(57) ABSTRACT

The antenna apparatus, comprises a coaxial cable having a core conductive wire for feeding signal, a radiation unit coupled to the coaxial cable, wherein the material and character of the radiation unit is substantially the same with the one of the coaxial cable, wherein the length of the radiation unit is approximately ((¼)+n) λ of an operation frequency of the antenna apparatus, wherein the n is an integer number that is greater than or equal to zero.

18 Claims, 6 Drawing Sheets x-z Palne

CABLE ANTENNA STRUCTURE

FIELD OF THE INVENTION

The present invention relates to a cable antenna apparatus, and more particularly, to a cable antenna apparatus constructed by the same coaxial cable.

BACKGROUND OF THE INVENTION

Various types of antennas are rapidly improvement along with the development of the communication technology. The IC technology is also developed with fast pace to provide a product with smaller size and lighter weight. The volume fact is one of important considerations to the antenna used for transmitting and receiving signal. One goal of the manufacture is to achieve the small product with light weight.

Antenna is employed to transmit or receive EM wave. The characters of the antenna can be obtained from the operating frequency, radiation pattern, return loss and antenna Gain. Small size, good performance and low cost are the most important facts for the current antenna to share larger marketing.

Typically, the well-known 2.4 GHz omni-directional antenna mainly involves the so-called sleeve antenna structure or spring structure antenna. However, both of the systems are too huge, it is unlikely to achieve the size reduction purpose and can not adapted to the wireless USB adaptor that are configured in small space. On the other hand, the signal feeding end of the antenna needs additional control IC to adjust the impedance match. The design of the apparatus is complicated, thereby increasing the manufacture cost.

Thus, what is desired is to develop a cable type antenna to provide a product with smaller size, lighter weight, and with the omni-directional capability for achieving the reduction purpose. No additional impedance match circuit is needed.

SUMMARY

The object of the present invention is to provide a cable antenna with smaller size, lighter weight, and with the omni-directional capability The antenna apparatus comprises a coaxial cable having a core conductive wire for feeding signal, a radiation unit coupled to the coaxial cable, wherein the material and character of the radiation unit is substantially the same with the one of the coaxial cable, wherein the length of the radiation unit is approximately ((¼)+n) λ of an operation frequency of the antenna apparatus, wherein the n is an integer number that is greater than or equal to zero. The antenna apparatus further comprises a fixing plate having a pair of sidewalls consisting of a first sidewall facing to a third sidewall, and a pair of sidewalls consisting of a second sidewall facing to a forth sidewall; a core wire pad located adjacent to the second sidewall; and a ground pad located adjacent to the first sidewall, wherein one end of the radiation unit is fixed and electrically coupled to the core wire pad, the other end of the radiation unit is connected on the ground pad.

The shape of the fixing plate is substantially square. The wide of the square fixing plate is set approximately between ((⅙)+(n/2)) λ and ((¼)+(n/2)) λ of the operation frequency, wherein the n is an integer number that is greater than or equal to zero. The length of the square fixing plate is configured approximately between ((1/12)+(n/2)) λ and ((⅛)+(n/2)) λ of the operation frequency, wherein the n is an integer number that is greater than or equal to zero. The fixing plate includes PCB. The ground plate is located at the substantially mid position of the first sidewall. The radiation unit is electrically coupled to the core wire pad by welding, and the radiation unit is electrically coupled the ground pad by welding. Wherein the length of the coaxial cable is about ((¼)+n) λ of the operation frequency, and the n is an integer number that is greater than or equal to zero.

DETAILED DESCRIPTION OF THE PRESENT INVENTION

Typically, the coaxial cable is constructed by a core conductive wire (such as copper, copper plate with zinc or steel) wrapped by an inner insulator (such as polyethylene), external conductive wire and external insulator. One aspect of the present invention is to provide a coaxial cable and to remove a part of the inner insulator the external conductive wire and the external insulator thereby exposing a part of the core conductive wire to act as an antenna.

Figure 1A:
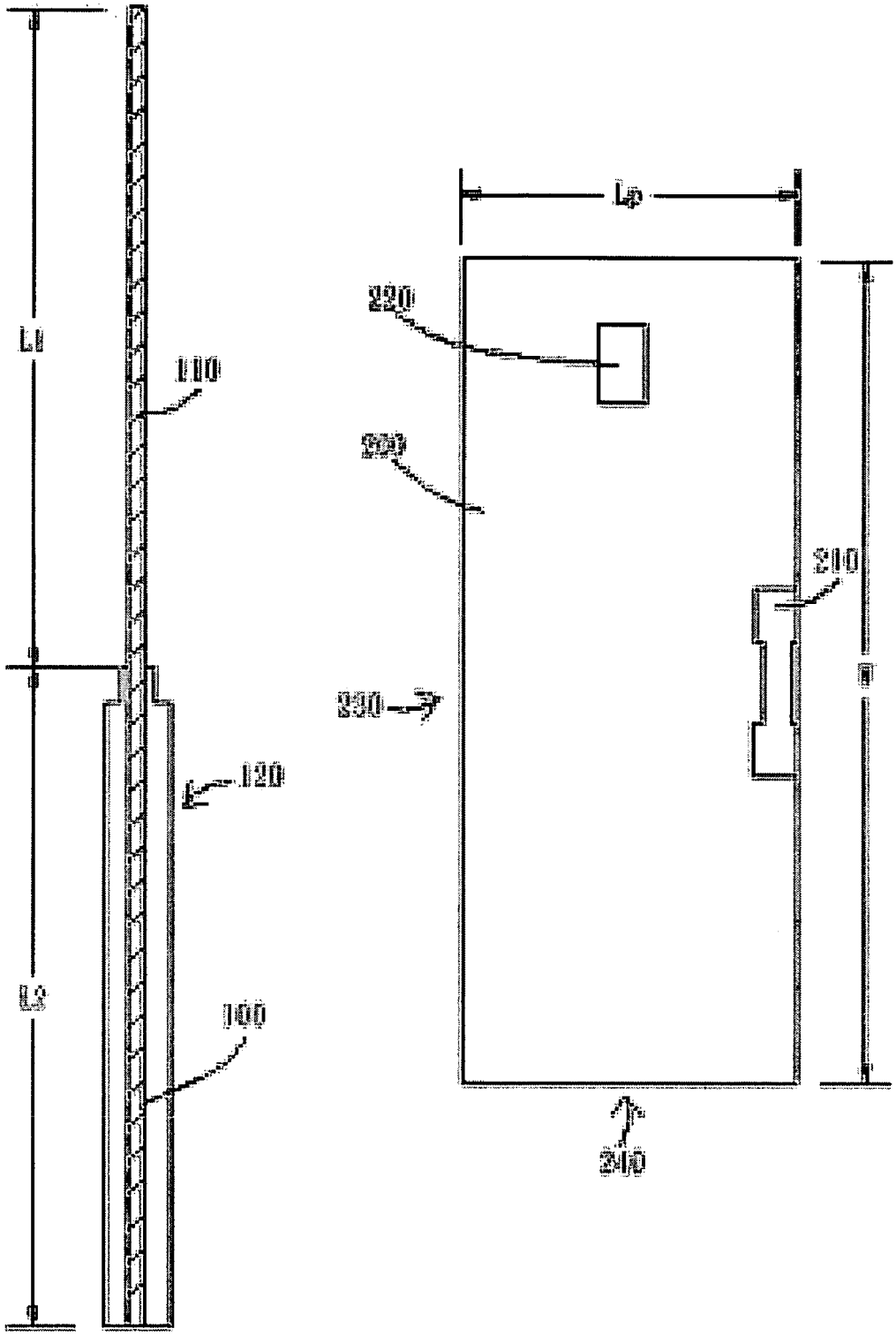
FIGS. 1A and 1B illustrate the configuration of the cable antenna according to the present invention.
Figure 1B:
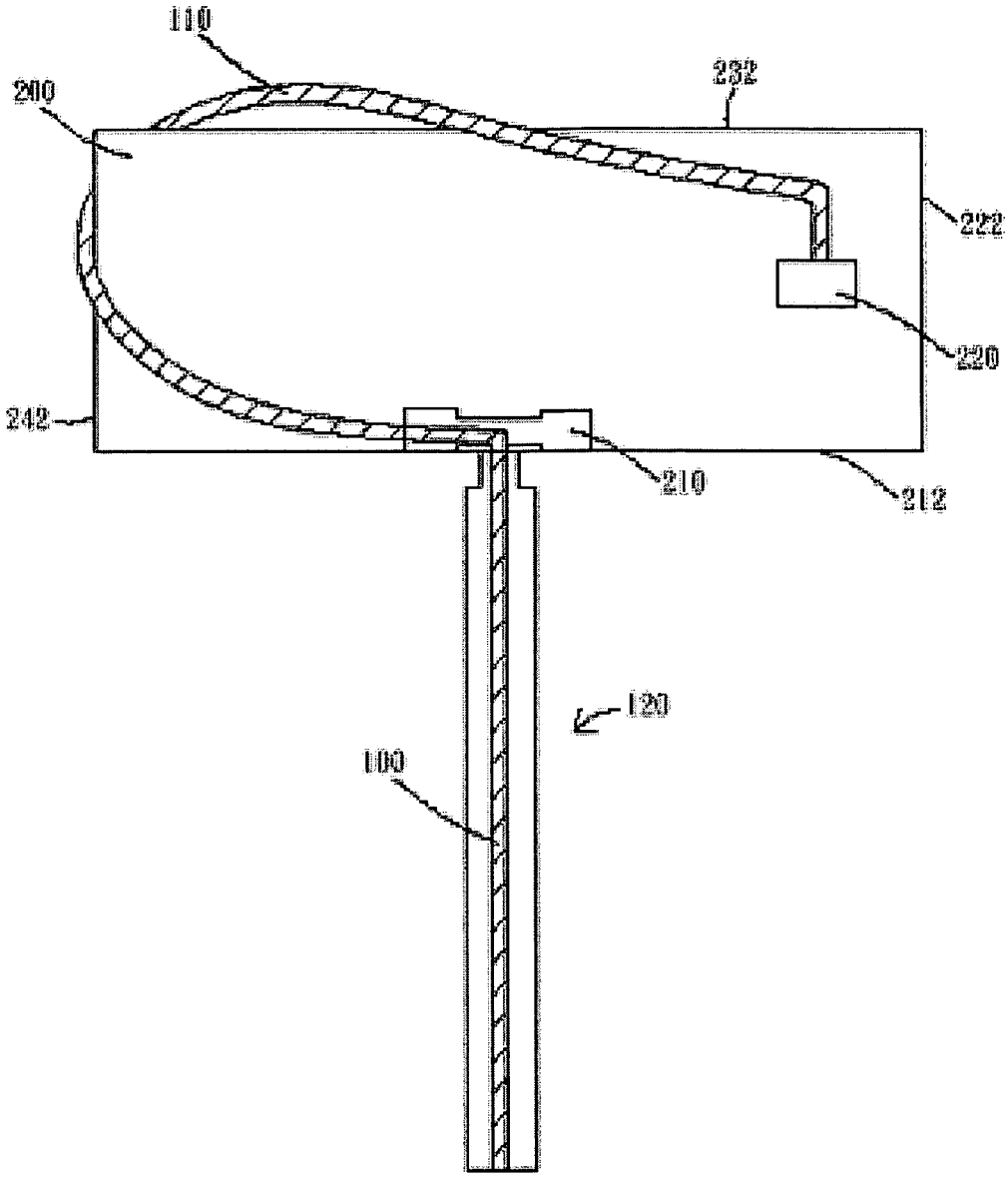

Please refer to FIGS. 1A and 1B, they illustrate the preferred embodiment of the present invention. The antenna includes a fixing plate 200, a core wire conductive pad 220, a ground welding pad 210, a coaxial cable 120 having a core conductive wire 100 and a radiation unit 110. The coaxial cable 120 acts as the feeding or input point of the antenna. The radiation unit 110 is electrically coupled to the core conductive wire 100 of the coaxial cable 120. The character and material of the radiation unit 110 is substantially the same with the one of the core conductive wire 100 of the coaxial cable 120. In one aspect, radiation unit 110 could be regard as the extension of the core conductive wire 100. Namely, the radiation unit 110 and the core conductive wire 100 could be formed by the identical coaxial cable (for example: 50Ω coaxial cable). The radiation unit 110 removes a part of the inner insulator the external conductive wire and the external insulator, and the remaining conductive wire is referred the radiation unit 110. The length of the radiation unit 110 is about (¼) λ of the operation frequency and the length of the coaxial cable 120 is about (¼) λ of the operation frequency. Further, the length of the coaxial cable 120 could be longer than the (¼) λ, for example, ((¼)+n) λ, wherein n is an integer number that is larger than or equal to zero. The preferred operation frequency of the antenna is about 2.45 GHz.

As shown in the FIGS. 1A and 1B, the fixing plate 200 includes a pair of sidewalls consisting of a first sidewall 212 facing to a third sidewall 232, and a pair of sidewalls consisting of a second sidewall 222 facing to a forth sidewall 242. The core wire welding pad 220 is adjacent to the second sidewall 222, and the ground welding pad 210 is located at the position (middle position) adjacent to the first sidewall 212. The fixing plate 200 could be PCB, and the shape could be circle, ellipse or the like. It well-known in the art, other shape and dimension could be used. The wide of the square fixing plate 200 is set approximately between ((1/6)+(n/2)) λ and ((1/4)+(n/2)) λ of the operation frequency while the length of the square fixing plate 200 is configured approximately between ((1/12)+(n/2)) λ and ((1/8)+(n/2)) λ of the operation frequency. One end of the radiation unit 10 is fixed and electrically coupled to the wire conductive pad 220 by welding. The other end of the radiation unit 110 is welded on the ground pad 210. It should be noted that other method could be employed to fix the radiation unit 10 on the pads 210 and 220. A gap (not shown) could be set between the third sidewall 232 and the forth sidewall 242 for engaging the radiation unit (bare core wire) 110 on the fixing plate 200.

It should be note that the present invention employs the identical coaxial cable to act the antenna. The feeding wire and the radiation unit 110 are constructed by the identical cable. Therefore, the impedance match circuit is no need for the feeding terminal, thereby reducing the design and manufacture cost and obtaining perfect impedance match. As aforementioned, the present invention may minimize the size of the antenna with cheaper cost, simpler process.

Figure 2:
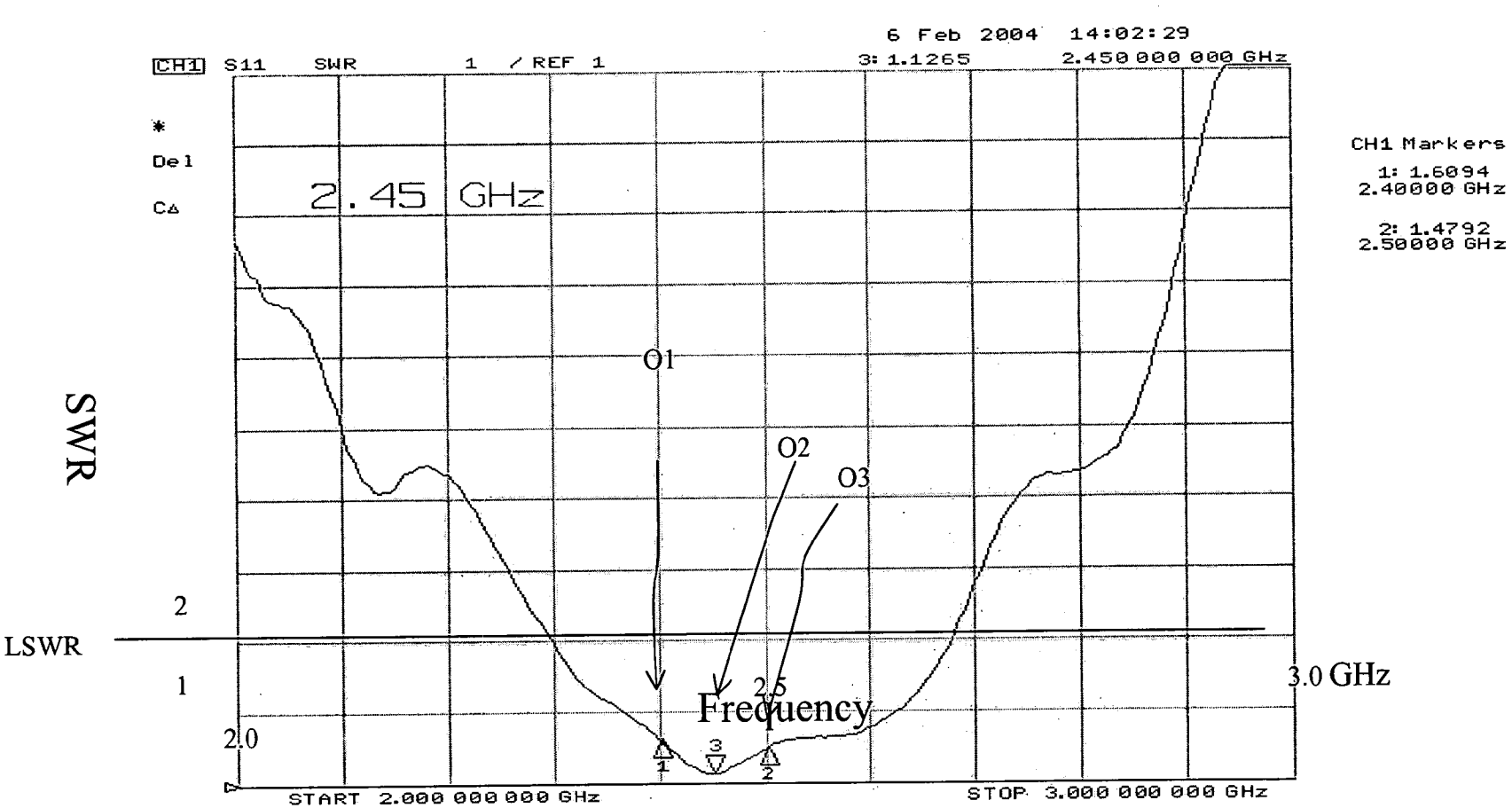
FIG. 2 illustrates the SWR(standing wave ratio) according to the present invention.

Please refer to FIG. 2, it shows the standing wave ratio data of the present invention. The standing wave ratio is around 1:1.6094 while the operation frequency is about 2.4 GHz (operation point O1). When the operation frequency is approximately 2.45 GHz (operation point O2), the standing wave ratio is around 1:1.1265. Similarly, when the operation frequency is approximately 2.5 GHz (operation point O3), the standing wave ratio 1:1.4792. If taking the line Ls of the standing wave ratio 1:1.7 as the base line, the operation point O1, O2 and O3 are all lower than the Ls, therefore, the 100 MHz bandwidth could be achieved under the operation frequency 2.45 GHz.

Figure 3A:
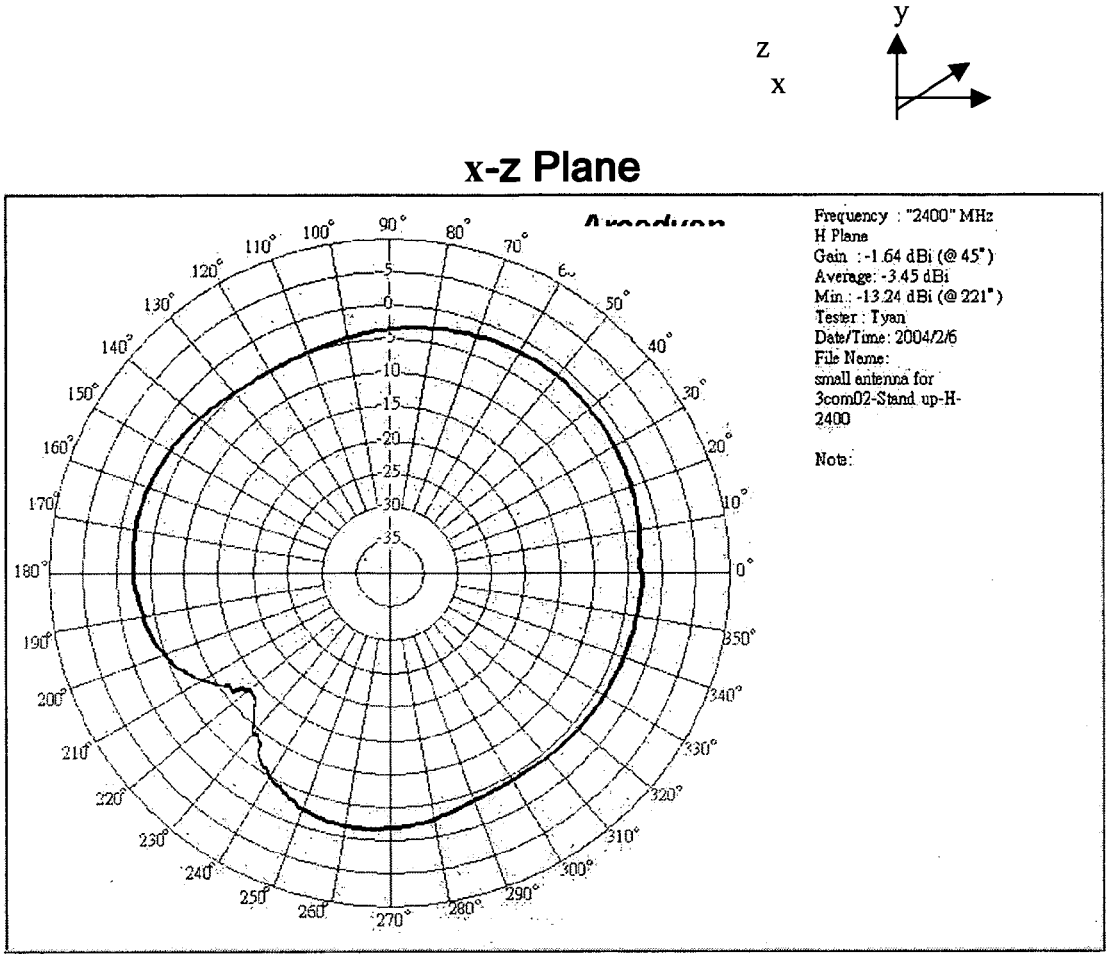
FIG. 3A illustrates the x-z radiation pattern under 2.40 GHz operation frequency according to the present invention.
Figure 3B:
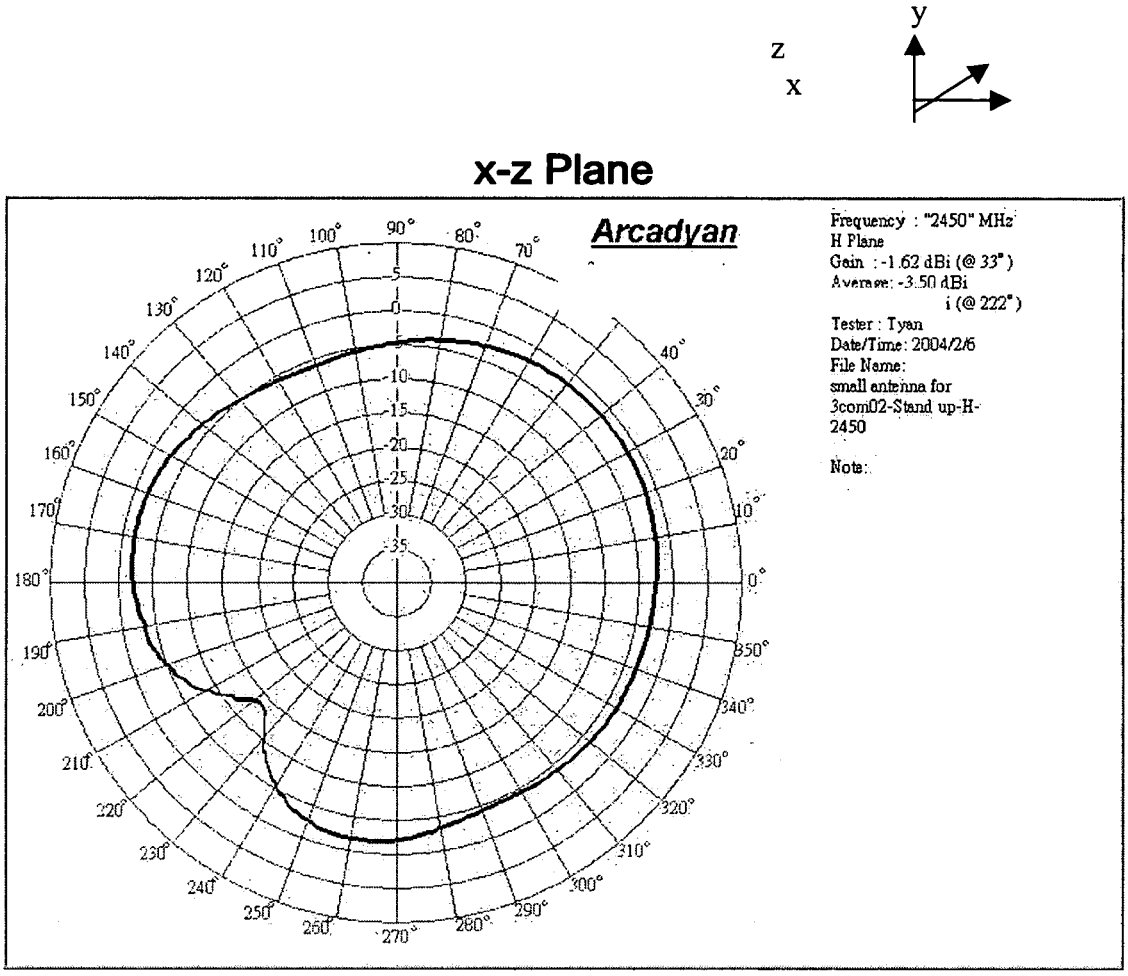
FIG. 3B illustrates the x-z radiation pattern under 2.45 GHz operation frequency according to the present invention.
Figure 3C:
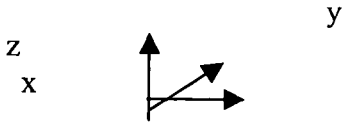
FIG. 3C illustrates the x-z radiation pattern under 2.50 GHz operation frequency according to the present invention.
Figure 3C:
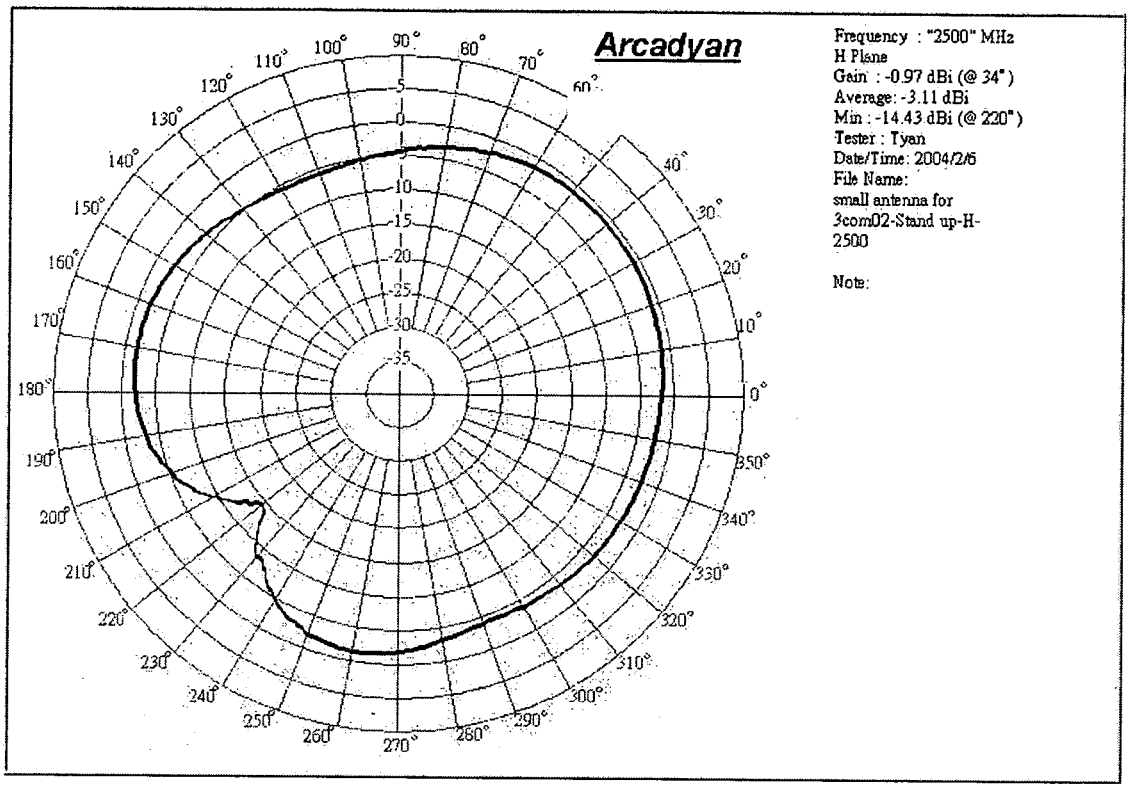

Please refer to FIGS. 3A to 3C, 3A illustrates the x-z radiation pattern under operation frequency 2.40 GHz according to the present invention. Similarly, 3C illustrates the x-z radiation pattern under operation frequency 2.50 GHz according to the present invention. From FIGS. 3A to 3C, the approximate circle x-z radiation pattern could be achieved under the operation frequency 2.40 GHz, 2.45 GHz and 2.50 GHz. To phrase another words, the omni-directional antenna system could be obtained by the present invention.

The benefit of the antenna includes simple structure, small size, low cost and omni-direction. No impedance match circuit is needed, thereby significantly reducing the manufacture cost.

Although specific embodiments have been illustrated and described, it will be obvious to those skilled in the art that various modifications may be made without departing from what is intended to be limited solely by the appended claims.

What is claimed is:

1. An antenna apparatus, comprising:

a coaxial cable having a core conductive wire for feeding signal;

a radiation unit coupled to said coaxial cable, wherein the material and character of said radiation unit is substantially the same with the one of said coaxial cable, wherein the length of said radiation unit is approximately ((1/4)+n) λ of an operation frequency of said antenna apparatus, wherein said n is an integer number that is greater than or equal to zero;

a fixing plate having a pair of sidewalls consisting of a first sidewall facing to a third sidewall, and a pair of sidewalls consisting of a second sidewall facing to a forth sidewall;

a core wire pad located adjacent to said second sidewall; and a ground pad located adjacent to said first sidewall, wherein one end of said radiation unit is fixed and electrically coupled to said core wire pad, the other end of said radiation unit is connected on said ground pad.

2. The antenna apparatus of claim 1, wherein the shape of said fixing plate is square.

3. The antenna apparatus of claim 2, wherein the wide of said square fixing plate is set approximately between ((1/6)+(n/2)) λ and ((1/4)+(n/2)) λ of said operation frequency, wherein said n is an integer number that is greater than or equal to zero.

4. The antenna apparatus of claim 2, wherein the length of the square fixing plate is configured approximately between ((1/12)+(n/2)) λ and ((1/8)+(n/2)) λ of said operation frequency, wherein said n is an integer number that is greater than or equal to zero.

5. The antenna apparatus of claim 1, wherein said fixing plate includes PCB.

6. The antenna apparatus of claim 1, wherein said ground pad is located at the substantially mid position of said first sidewall.

7. The antenna apparatus of claim 1, wherein said radiation unit is electrically coupled to said core wire pad by welding.

8. The antenna apparatus of claim 1, wherein said radiation unit is electrically coupled said ground pad by welding.

9. The antenna apparatus of claim 1, wherein the length of said coaxial cable is about ((1/4)+n) λ of said operation frequency, wherein said n is an integer number that is greater than or equal to zero.

10. An antenna apparatus, comprising:

a fixing plate having a pair of sidewalls consisting of a first sidewall facing to a third sidewall, and a pair of sidewalk consisting of a second sidewall facing to a forth sidewall;

a core wire pad located adjacent to said second sidewall;

a ground pad located adjacent to said first sidewall;

a coaxial cable having a core conductive wire for feeding signal; and a radiation unit coupled to said coaxial cable, wherein the material and character of said radiation unit is substantially the same with the one of said coaxial cable, wherein one end of said radiation unit is fixed and electrically coupled to said core wire pad, the other end of said radiation unit is connected on said ground pad, wherein said radiation unit is the extension of said coaxial cable;

wherein the length of said radiation unit is approximately ((1/4)+n) λ of an operation frequency of said antenna apparatus, wherein said n is an integer number that is greater than or equal to zero.

11. The antenna apparatus of claim 10, wherein the shape of said fixing plate is square.

12. The antenna apparatus of claim 11, wherein the wide of said square fixing plate is set approximately between ((1/6)+(n/2)) λ and ((1/4)+(n/2)) λ of said operation frequency, wherein said n is an integer number that is greater than or equal to zero.

13. The antenna apparatus of claim 11, wherein the length of the square fixing plate is configured approximately between ((1/12)+(n/2)) λ and ((1/8)+(n/2)) λ of said operation frequency, wherein said n is an integer number that is greater than or equal to zero.

14. The antenna apparatus of claim 10, wherein said fixing plate includes PCB.

15. The antenna apparatus of claim 10, wherein said ground pad is located at the substantially mid position of said first sidewall.

16. The antenna apparatus of claim 10, wherein said radiation unit is electrically coupled to said core wire pad by welding.

17. The antenna apparatus of claim 10, wherein said radiation unit is electrically coupled said ground pad by welding.

18. The antenna apparatus of claim 10, wherein the length of said coaxial cable is about ((¼)+n) λ of said operation frequency, wherein said n is an integer number that is greater than or equal to zero.

* * * * *